US005213677A

United States Patent [19]

Yamamoto et al.

[11] Patent Number: 5,213,677

[45] Date of Patent: May 25, 1993

[54] SPINNING PITCH FOR CARBON FIBERS AND PROCESS FOR ITS PRODUCTION

[75] Inventors: Iwao Yamamoto; Ryuichi Hara, both of Yokohama; Toshiyuki Tajiri, Tama; Kazuo Shirosaki, Sagamihara; Akihiko Yoshiya, Yokohama, all of Japan

[73] Assignee: Mitsubishi Kasei Corporation, Tokyo, Japan

[21] Appl. No.: 780,344

[22] Filed: Oct. 22, 1991

[30] Foreign Application Priority Data

Oct. 22, 1990 [JP] Japan ..... 2-283997

[51] Int. Cl.[5] ..... C10C 3/00; C10C 3/08

[52] U.S. Cl. ..... 208/39; 208/22; 208/44; 208/45; 423/447.4

[58] Field of Search ..... 208/39, 44, 22, 45; 423/447.4

[56] References Cited

U.S. PATENT DOCUMENTS

| | | | |
|---|---|---|---|
| 4,277,325 | 7/1981 | Greenwood | 423/447.4 |
| 4,502,943 | 3/1985 | Dickakian | 208/39 |
| 4,518,482 | 5/1985 | Dickakian | 208/22 |
| 4,548,704 | 12/1985 | Dickakian | 423/447.1 |
| 4,620,919 | 11/1986 | Uemura et al. | 208/45 |

OTHER PUBLICATIONS

"CRC Handbook of Chemistry and Physics", Robert C. Weast, et al., editors, pp. C-680-683, C-726, 1990.

*Primary Examiner*—Theodore Morris
*Assistant Examiner*—P. L. Hailey
*Attorney, Agent, or Firm*—Oblon, Spivak, McClelland, Maier & Neustadt

[57] ABSTRACT

Spinning pitch for carbon fibers, which (1) has a glass transition temperature width of at most 60° C. as measured by a differential scanning calorimeter, (2) contains at least 80% by volume an optically anisotropic phase, and (3) shows a shear viscosity of 200 poise at a temperature of from 270° to 370° C.

6 Claims, 1 Drawing Sheet

SPINNING PITCH FOR CARBON FIBERS AND PROCESS FOR ITS PRODUCTION

BACKGROUND OF THE INVENTION

The present invention relates to spinning pitch for carbon fibers and a process for its production. More particularly, it relates to spinning pitch which provides carbon fibers having high strength and high modulus of elasticity, and a process for its production.

Carbon fibers and graphite fibers have very high specific strength and specific modulus and thus are used as reinforcing materials for various composite materials for a wide range of applications including sporting goods such as fishing rods and shafts of golf clubs, medical equipments such as artificial hands and artificial legs and aerial and space navigation parts such as wings of aircrafts and doors of space shuttles.

High performance carbon fibers and graphite fibers are generally classified into polyacrylonitrile (PAN) type and pitch type. Carbon fibers and graphite fibers of pitch type are prepared usually by using coal, petroleum or the like as the starting material. As is well known, when carbonaceous material such as heavy oil, tar or pitch is heated to a temperature of from 350° to 500° C., small spherical particles having a particle size of from a few microns to a few hundred microns and showing optical anisotropy under a polarized light, will form in such material. When the material is further heated, such small spherical particles will grow and integrate and finally the entire material will show the optical anisotropy. This anisotropic composition is considered to be a precursor for a graphite crystal structure, wherein a high molecular weight aromatic hydrocarbon formed by the thermal polycondensation reaction of carbonaceous material is laminated and oriented in a layered fashion.

It has been proposed to use such a thermally treated product as a starting material for high performance carbon fibers of pitch type having excellent properties such as high strength and high modulus of elasticity, by melt-spinning it through spinning nozzles, followed by infusible treatment, carbonization and if necessary graphitization.

For producing spinning pitch containing a particularly large amount of an optical anisotropic phase, it is already known to produce spinning pitch by heat-treating carbonaceous material under stirring or while blowing an inert gas or the like thereinto, as disclosed in Japanese Unexamined Patent Publications No. 42924/1982 and No. 168687/1983 or to produce spinning pitch by heat-treating carbonaceous material, followed by treatment with an aromatic solvent to recover a solvent insoluble component by solvent fractionation, as disclosed in Japanese Examined Patent Publications No. 5433/1988 and No. 53317/1989.

However, such conventional spinning pitch contains a low softening point component irrespective of the type of spinning pitch. When pitch containing such a low softening point component is subjected to melt-spinning, followed by infusible treatment and carbonization to produce carbon fibers, the elastic modulus of the resulting carbon fibers tends to be inadequate due to the presence of such a low softening point component, and to supplement the deficiency in the elastic modulus, it is necessary to increase the baking temperature. If the elastic modulus is increased by increasing the baking temperature, the compression strength at 0° C. of the resulting carbon fibers tends to be low, whereby it tends to be difficult to obtain high performance carbon fibers. To solve such a problem, it is conceivable to remove the low softening component by such means as solvent-extraction. However, if the low softening point component is simply removed from spinning pitch, the softening point of the spinning pitch will be high, whereby it will be necessary to increase the spinning temperature.

Under these circumstances, the present inventors have conducted extensive researches to solve such problems and as a result, have found it effective to adequately remove not only the low softening point component but also the high softening point component from spinning pitch, and they further found that with the spinning pitch having the low softening point component and the high softening point component adequately removed, the width of glass transition temperature ($\Delta Tg$) as measured by a differential scanning calorimeter is small and that the spinning pitch having a small $\Delta Tg$ and a large content of an optically anisotropic phase and showing a predetermined viscosity at the spinning temperature, is capable of solving the above problems and capable of presenting high performance carbon fibers without any problems in the process. The present invention has been accomplished on the basis of these discoveries.

Further, the present inventors have found that by treating carbonaceous material having a high content of an optically anisotropic phase, with solvents having certain specific solubility parameters, it is possible to adequately remove the low softening point component and the high softening point component and to obtain spinning pitch showing certain specific physical properties. The present invention has been accomplished based also on this discovery.

SUMMARY OF THE INVENTION

Thus, it is an object of the present invention to obtain spinning pitch which is spinnable and which is capable of producing carbon fibers of pitch type having high modulus of elasticity and high compression strength at 0° C. by baking treatment at a relatively low temperature, and to provide a method for producing such spinning pitch in a simple manner.

Such an object can readily be accomplished by spinning pitch for carbon fibers, which (1) has a glass transition temperature width of at most 60° C. as measured by a differential scanning calorimeter, (2) contains at least 80% by volume an optically anisotropic phase, and (3) shows a shear viscosity of 200 poise at a temperature of from 270° to 370° C., and a process for producing spinning pitch for carbon fibers which comprises solvent-fractionating carbonaceous material by means of two types of organic solvents having different solubility parameters, wherein said carbonaceous material contains at least 30% by volume of an optically anisotropic phase, and (1) said carbonaceous material is treated with an organic solvent (a) having a solubility parameter of from 9.5 to 11.5 to obtain a soluble component, and then said soluble component is treated with an organic solvent (b) having a solubility parameter of from 8.0 to 10.6 to obtain an insoluble component, or (2) said carbonaceous material is treated with an organic solvent (b) having a solubility parameter of from 8.0 to 10.6 to obtain an insoluble component, and then said insoluble component is treated with an organic solvent (a) having a solubility parameter of from 9.5 to 11.5 to obtain a soluble component, wherein the difference in the solubility parameter between the organic solvent (a) and the organic solvent (b) is at least 0.1, and the insoluble component obtained by the method (1) or the soluble component obtained by the method (2) has at least 80% by volume of an optically anisotropic phase and shows a shear viscosity of 200 poise at a temperature of from 270° to 370° C.

BRIEF DESCRIPTION OF THE DRAWING

In the accompanying drawing.

DESCRIPTION OF THE PREFERRED EMBODIMENTS

Figure 1:
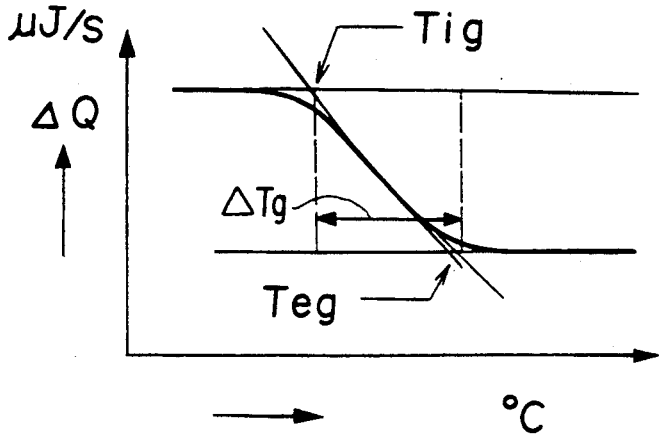
FIG. 1 is a graph illustrating the manner of obtaining the glass transition temperature width, wherein the abscissa indicates the temperature, and the ordinate indicates the quantity of absorbed heat per unit time of the spinning pitch at the temperature.

Now, the present invention will be described in detail with reference to the preferred embodiments.

The spinning pitch for carbon fibers of the present invention has a feature that it (1) has a glass transition temperature width of at most 60° C. as measured by a differential scanning calorimeter, (2) contains at least 80% by volume of an optically anisotropic phase, and (3) shows a shear viscosity of 200 poise at a temperature of from 270° to 370° C.

The glass transition temperature width ($\Delta Tg$) as measured by a differential scanning calorimeter, is an index showing whether or not the low softening point component and the high softening point component have been adequately removed. The present inventors have found that only when the glass transition temperature width ($\Delta Tg$) of spinning pitch is at most 60° C. as measured by this method, carbon fibers produced therefrom will attain the quality of high performance carbon fibers for the first time.

The glass transition temperature is a temperature specific to a substance, at which the physical properties such as the specific heat of the substance changes discontinuously. However, in the case of a material containing various molecular structures and having a wide molecular weight distribution ranging from a low softening point component to a high softening point component, like spinning pitch, the glass transition temperature has a certain width, since such a material is a mixture of many substances. Namely, in the case of spinning pitch containing many molecular species ranging from a low softening point component to a high softening point component and having a wide molecular weight distribution, the glass transition temperature width tends to be large.

Further, with spinning pitch having the low softening point component unsuitable for the production of high performance carbon fibers removed, the viscosity of the spinning pitch tends to be high, and the temperature suitable for the melt-spinning tends to be high, whereby thermal decomposition and thermal polycondensation reactions of the spinning pitch tend to take place, and it becomes difficult to produce carbon fibers. To maintain the viscosity of the spinning pitch to a proper level, it is necessary to remove the high softening point component at the same time as the removal of the low softening point component. With spinning pitch thus prepared, the glass transition temperature width ($\Delta Tg$) is small, and when the glass transition temperature width is at most 60° C., it becomes possible to produce high performance carbon fibers.

The starting material of carbonaceous material containing at least 30% by volume of an optically anisotropic phase may, for example, be a coal-originated pitch such as coal tar, coal tar pitch or liquefied coal, or a petroleum-originated pitch such as FCC oil, caulker oil or a distillation residue thereof, or a pitch produced by heating and distilling under reduced pressure an aromatic resin produced by poly-condensing naphthalene or anthracene with a catalyst or formalin, or an oligomer obtained by cross-linking an alkyl benzene with a formaldehyde in the presence of a strong acid catalyst, which contains a benzene-insoluble component in an amount of at most 95% by weight, preferably at most 70% by weight, more preferably from 5 to 45% by weight, and a quinoline-insoluble component in an amount of at most 40% by weight, preferably at most 30% by weight, more preferably at most 20% by weight.

The quinoline-insoluble component of such starting material may sometimes be composed of fine particles of e.g. coke, carbon black or ash. If such fine particles are included in spinning pitch, the spinnability tends to deteriorate, and the resulting carbon fibers tend to have poor strength. To avoid such a drawback, it is advisable to remove such quinoline-insoluble component from the starting material by pretreatment such as separation by sedimentation, followed by a suitable treatment to bring the proportion of the optically anisotropic phase to a level of at least 30% by volume, and then use it for the production of spinning pitch of the present invention. Otherwise, pretreatment may be conducted in such a manner that the starting material having the quinoline-insoluble component removed as described above, is subjected further to hydrogenation treatment under hydrogen gas pressure at a temperature of from 360° to 500° C. together with a hydrogen-donative solvent such as tetraline, decaline, tetrahydroquinoline or hydrogenated aromatic oil, or together with a mixture comprising a solvent which can readily be converted to a hydrogen-donative solvent, such as quinoline, naphthalene oil or anthracene oil, and a supported or non-supported catalyst containing e.g. an iron-type compound or molybdenum as catalyst, followed by removal of a solid content by e.g. filtration and, if necessary, by removal of the solvent by e.g. distillation, and then the pretreated material is subjected to a suitable treatment to bring the proportion of the optically anisotropic phase to a level of at least 30% by volume, before using it for the production of spinning pitch of the present invention.

The above suitable treatment may be conducted in such a manner that the starting material pre-treated by the removal of the quinoline-insoluble component or by the hydrogenation treatment, is heat-treated at a temperature of from 300° to 500° C., preferably from 380° to 450° C. under a pressure ranging from reduced pressure to 10 kg/cm$^2$.G, preferably from 10 mmHg to atmospheric pressure for from 20 minutes to 10 hours, preferably from 1 to 6 hours, in an inert gas atmosphere or while blowing an inert gas into the pitch. A method is known in which this treatment is continued to obtain spinning pitch composed of an optically anisotropic phase. This method is a conventional method for obtaining a spinning material for high performance carbon fibers. However, the pitch thereby obtained contains a low softening point component. It is known that if such pitch is subjected to melt-spinning, infusible treatment and carbonization treatment to obtain carbon fibers, the modulus of elasticity can hardly be increased, and if the baking temperature is raised to increase the modulus of elasticity, the compression strength at 0° C. tends to be low. On the other hand, if only the low softening point component is merely removed from spinning pitch, the softening point of the spinning pitch tends to increase, whereby the spinning operation tends to be difficult.

The carbonaceous material to be used in the present invention contains at least 30% by volume, preferably at least 90% by volume, of an optically anisotropic phase.

The present invention is intended to provide high performance carbon fibers by producing an optically anisotropic spinning pitch having a narrow molecular weight distribution. The carbonaceous starting material to be used in the present invention is required to contain at least 30% by volume, preferably at least 90% by volume, of an optically anisotropic phase. If spinning pitch is prepared from carbonaceous starting material containing less than 30% by volume of an optically anisotropic component and such pitch is used for the production of carbon fibers, it tends to be difficult to conduct spinning under a stabilized condition, and it tends to be difficult to obtain high performance carbon fibers intended by the present invention. The carbonaceous starting material containing less than 30% by volume of an optically anisotropic phase, usually contains a large amount of a component which is hardly capable of forming liquid crystal. Such component is a low molecular weight low softening point component or a component in which a low molecular weight component is not polycondensed to form an aromatic plate-structure. It contains a component wherein aliphatic hydrocarbons constitute a high proportion and has a chemical structure wherein low molecular weight monomers are oligomerized to have three-dimensional structures by e.g. methylene cross linkages. Such carbonaceous starting material is thermally unstable and is likely to undergo a partial decomposition reaction at the melt-spinning temperature.

Such a component constituted by low molecular compounds, can hardly be removed completely even by solvent fractionation, and a part thereof will be included in the resulting spinning pitch. Such a component will undergo partial decomposition at the spinning temperature thereby forming bubbles, which cause breakage of spinning nozzles. Further, three-dimensionally oligomerized product by e.g. methylene cross linkages, causes irregularities in the viscosity of the molten spinning pitch and thus makes it difficult to attain a stabilized spinning state continuously. In order to produce spinning pitch which is capable of providing a stabilized spinning state, it is necessary to preliminarily remove such a component constituted by low molecular weight compounds. For this purpose, the starting material must be carbonaceous material containing at least 30% by volume of an optically anisotropic phase. Preferably, it contains at least 90% by volume of an optically anisotropic phase.

In the present invention, it is important that the carbonaceous material thus treated to have at least 30% by volume of an optically anisotropic phase, is subjected to solvent-fractionation by means of two types of organic solvents having different solubility parameters. The solvent fractionation may be conducted by either one of the following methods:

(1) The carbonaceous material is treated with an organic solvent (a) having a solubility parameter of from 9.5 to 11.5 to obtain a soluble component, and then the soluble component is treated with an organic solvent (b) having a solubility parameter of from 8.0 to 10.6 to obtain an insoluble component; and (2) The carbonaceous material is treated with an organic solvent (b) having a solubility parameter of from 8.0 to 10.6 to obtain an insoluble component, and then the insoluble component is treated with an organic solvent (a) having a solubility parameter of from 9.5 to 11.5 to obtain a soluble component.

Here, the solubility parameter used in the present invention is a solubility parameter of the solvent or the mixture of solvents to be used and is defined by the following formula:

Solubility parameter $$(\nu) = \left[\frac{(Hv - RT}{V}\right]^{\frac{1}{2}}$$

wherein Hv is the heat of vaporization of the solvent, R is the molecular gas constant, T is the temperature represented by absolute temperature, and V is the molecular volume.

Such solubility parameter ($\nu$) is described in detail, for example, in "Solubility of Non-electrolytes" edited by J. Hildebrand and R. Scott (Third Edition, published by Rinehold Company, 1949). Solubility parameters of typical solvents include, for example, 8.9 of toluene, 9.2 of benzene, 9.2 of chloroform, 9.5 of tetrahydrofuran, 10.6 of pyridine and 10.8 of quinoline. It is, of course, possible to prepare a solvent of a desired solubility parameter by using a plurality of such solvents in a proper combination.

The organic solvent (a) to be used in the present invention has a solubility parameter within a range of from 9.5 to 11.5. As such an organic solvent, pyridine, quinoline or a mixture thereof may, for example, be mentioned. If the solubility parameter of the organic solvent (a) is too large, the compatibility with carbonaceous material will be lost, and if it is too small, the optical anisotropy in the spinning pitch will hardly be developed, and the solubility parameter tends to be close to the solubility parameter of the organic solvent (b), whereby the yield tends to deteriorate, such being undesirable. The solubility parameter is selected usually within a range of from 9.5 to 11.5, preferably from 10 to 11.

The organic solvent (b) has a solubility parameter within a range of from 8.0 to 10.6. As such an organic solvent, toluene, benzene, chloroform, tetrahydrofuran, pyridine or a mixture thereof, may, for example, be mentioned. If the solubility parameter of the organic solvent (b) is too small, the low softening point component causing a deterioration of the modulus of elasticity, will be contained, and if it is too large, the softening point tends to be high, and the solubility parameter will be close to the solubility parameter of the organic solvent (a), whereby the yield tends to be low, such being undesirable. The solubility parameter of the organic solvent (b) is selected usually within a range of from 8.0 to 10.6, preferably from 8.5 to 10.

By using such solvents, solvent fractionation of the present invention is carried out.

According to the method (1), the above described carbonaceous material is dissolved by the organic solvent (a) having a solubility parameter of from 9.5 to 11.5, and the insoluble component i.e. the high softening point component contained in the material is separated and removed by filtration to obtain a soluble component. The amount of the organic solvent (a) used in this step is selected within a range of at least 300 parts by weight, preferably from 500 to 2,000 parts by weight, per 100 parts by weight of the carbonaceous material.

Then, such a soluble component is dissolved by the organic solvent (b) having a solubility parameter of from 8.0 to 10.5, and a soluble component i.e. a low softening point component contained in said soluble component, which hinders development of a high modulus of elasticity, is separated and removed by filtration to obtain an insoluble component. The amount of the organic solvent (b) used in this step is selected within a range of at least 300 parts by weight, preferably from 500 to 2,000 parts by weight, per 100 parts by weight of the soluble component.

The method (2) is conducted in the same manner as the method (1) except that the steps of the method (1) are reversed.

Here, selection of the solubility parameters of the organic solvents (a) and (b) to be used is of importance. Namely, it is necessary that the difference in the solubility parameter between the organic solvent (a) and the organic solvent (b) to be used, is at least 0.1. If the difference in the solubility parameter between the organic solvent (a) and the organic solvent (b) is too large, spinning pitch obtainable by the method (1) or (2) will not be remarkably improved over conventional spinning pitch. On the other hand, if it is too small, the yield of spinning pitch obtained by the method (1) or (2) will be low, such being undesirable. It is usually necessary to select the organic solvents (a) and (b) so that such a difference would be within a range of from 0.1 to 3.5, preferably from 0.2 to 2.5.

The spinning pitch obtained by such a method has at least 80%, preferably at least 85%, more preferably at least 95%, of an optically anisotropic phase and shows a shear viscosity of 200 poise at a temperature of from 270° to 370° C. Namely, if the temperature for a shear viscosity of 200 poise exceeds 370° C. by e.g. the combination of the upper limits of the solubility parameters of both organic solvents, or if the optically anisotropic phase is less than 80% by e.g. the combination of the lower limits of the solubility parameters of both solvents, no adequate effects of the present invention will be obtained. In such a case, it is necessary to select the organic solvents so that the physical properties will be in the above specified ranges.

The organic solvents useful in the present invention are not limited to single component or double component solvents and may be multi component solvents, such as liquefied coal, petroleum-originated heavy oil and tar oil, so long as they show the same solubility to carbonaceous material.

The glass transition temperature width of the spinning pitch thus obtained, was measured by a differential scanning calorimeter. This measurement was conducted in accordance with JIS K7121-1987 "Method for Measuring the Transition Temperature of Plastics". The glass transition temperature width (ΔTg) was obtained as the difference between Tig and Teg as shown in FIG. 1 from the DSC curve obtained by this method, in accordance with JIS K7121-1987 "9.3 Method for Determining the Glass Transition Temperature". Specifically, the temperatures at the intersecting points of linear lines extended from the respective base lines before and after the glass transition and the tangential line at the maximum gradient of the curve at the stepwise changing portion of the glass transition, are designated as Tig and Teg (corresponding to the low temperature side base line and the high temperature side base line, respectively). The glass transition temperature width (ΔTg) is represented by the difference between Tig and Teg.

The spinning pitch thus obtained, is used for the production of carbon fibers in accordance with a conventional method. The carbon fibers may be produced by melt-spinning such spinning pitch at a temperature of e.g. from 300° to 400° C., followed by infusible treatment in an oxidizing atmosphere, and subjecting the obtained fiber tow to carbonization treatment at a temperature of from 1,500° to 2,000° C., and if necessary, to graphitization treatment at a temperature of from 2,200° to 3,000° C. to obtain the desired carbon fibers or graphite fibers. It is particularly noteworthy that with the spinning pitch of the present invention, a high modulus of elasticity can be obtained by baking at a relatively low temperature. In other words, when compared at the same baking temperature, carbon fibers having a remarkably high modulus of elasticity can be obtained according to the present invention.

Now, the present invention will be described in further detail with reference to Examples. However, it should be understood that the present invention is by no means restricted to such specific Examples.

In the following Examples, "parts" means "parts by weight" unless otherwise specified.

COMPARATIVE EXAMPLE 1

A mixture comprising 100 parts of petroleum-originated coal tar pitch having a quinoline-insoluble solid removed therefrom, 100 parts of creosote oil, 5 parts of iron oxide and 2.4 parts of sulfur, was continuously supplied to an autoclave equipped with a stirrer and treated for hydrogenation under a hydrogen pressure of 150 kg/cm$^2$.G at a temperature of 470° C. for an average retention time of two hours. The treated product was subjected to filtration to remove the iron catalyst, etc. Then, the solvent was distilled off by distillation under reduced pressure to obtain hydrogenated pitch.

This hydrogenated pitch was heat-treated at 430° C. for 120 minutes while supplying nitrogen under atmospheric pressure. The optically anisotropic phase of the spinning pitch thus obtained, was 95%, and the temperature at which the shear viscosity was 200 poise, was 344° C. This spinning pitch was subjected to melt-spinning, whereby pitch fibers having a fiber diameter of 10 μm were spun for two hours without breakage. The pitch fibers having a fiber diameter of 10 μm thus obtained was subjected to infusible treatment by raising the temperature to 310° C. over a period of 160 minutes in air, followed by two step carbonization treatment by heating the fibers at 1,000° C. for 60 minutes and then at 2,000° C. for 30 minutes in argon, to obtain carbon fibers. The physical properties of the carbon fibers were measured in accordance with the tensile test method for monofilaments as stipulated in JIS R-7601, and the results are shown in Table 1.

On the other hand, the fibers treated by infusible treatment was carbonized for one minute at the temperature as identified in Table 1, and the physical properties of the carbon fibers were measured in accordance with a test method for compression strength at 0° C. as stipulated in ASTM T3410, and the results are also shown in Table 1.

By means of SSC 580 series DSC-20 Model apparatus manufactured by Seiko Denshi Sha, the DSC curve of the spinning pitch used for spinning was obtained in accordance with the method of JIS K7121-1987. Specifically, using an aluminum dish for a sample and an empty aluminum dish also for a standard substance, 15 mg of spinning pitch was preliminarily heat-treated at 350° C. under a stream of 15 ml/min of nitrogen gas, rapidly cooled to room temperature and then heated at a constant temperature raising rate of 15° C./min, whereby the measurement was conducted. The glass transition temperature width (ΔTg) thus obtained was 80° C.

EXAMPLE 1

A mixture comprising 10 parts of the same spinning pitch as used in Comparative Example 1 and 100 parts of a solvent mixture (b) (95 parts of toluene and 5 parts of pyridine) was subjected to solubilization treatment at 110° C. for one hours by a container equipped with a stirrer, whereupon a soluble component was removed by filtration. Then, a mixture comprising 10 parts of an insoluble component thus obtained and 100 parts of quinoline as solvent (a), was subjected to solubilization treatment under the same condition, whereupon an insoluble component was removed by filtration. Quinoline was distilled off from the soluble component thus obtained to obtain spinning pitch containing 95% of an optically anisotropic phase. The temperature at which the shear viscosity of this spinning pitch was 200 poise, was 335° C., and this spinning pitch was melt-spun in the same manner as in Comparative Example 1 to obtain carbon fibers. The spinnability and the mechanical properties of the carbon fibers are shown in Table 1.

The solubility parameter of the solvent mixture (b) used here was 9.0, since that of toluene was 8.9 and that of pyridine was 10.6. The solubility parameter of quinoline was 10.8.

Further, the glass transition temperature width (ΔTg) of the spinning pitch produced here, was 55° C.

EXAMPLE 2

Using pyridine as solvent (a) and a solvent mixture comprising 60% of toluene and 40% of pyridine, as solvent (b), the spinning pitch used in Comparative Example 1 was treated under the same condition as in Example 1 in the method ① to obtain spinning pitch. The temperature at which this spinning pitch showed a shear viscosity of 200 poise, was 351° C. From this spinning pitch, carbon fibers were prepared in the same manner as in Comparative Example 1. The spinnability and the mechanical properties of the carbon fibers are shown in Table 1.

The solubility parameter of solvent (a) (pyridine) used here, was 10.6, and that of solvent (b) (solvent mixture comprising 60% of toluene and 40% of pyridine) was 9.6.

Further, the glass transition temperature width (ΔTg) of the spinning pitch produced here, was 47° C.

EXAMPLE 3

Using pyridine as solvent (a) and a solvent mixture comprising 50 parts of toluene and 50 parts of pyridine, as solvent (b), the same spinning pitch as used in Comparative Example 1 was treated under the same condition as in Example 1 by the method ② to obtain spinning pitch. However, in this Example, to improve the extraction efficiency by the solvents, the respective extraction was repeated three times under the same condition. The optically anisotropic phase of this spinning pitch was 95%, and the temperature at which the spinning pitch showed a shear viscosity of 200 poise, was 334° C.

This spinning pitch was treated in the same manner as in Comparative Example 1 to obtain carbon fibers. The spinnability and the mechanical properties of the carbon fibers are shown in Table 1.

The solubility parameter of solvent (b) (solvent mixture comprising 50% of toluene and 50% of pyridine) used in this Example, was 9.8. Further, the glass transition temperature width (ΔTg) of the spinning pitch obtained in this Example, was 43° C.

EXAMPLE 4

The hydrogenated pitch in Comparative Example 1 was heat-treated for 30 minutes, and the pitch containing 35% by volume of an optically anisotropic phase, was treated in the same manner as in Example 3 to obtain spinning pitch containing 95% by volume of an optically anisotropic phase. The temperature at which this spinning pitch showed a shear viscosity of 200 poise, was 340° C. This spinning pitch was melt-spun and treated in the same manner as in Comparative Example 1 to obtain carbon fibers. The spinnability and the mechanical properties of the carbon fibers are shown in Table 1.

The glass transition temperature width (ΔTg) of the spinning pitch obtained in this Example, was 44° C.

COMPARATIVE EXAMPLE 2

The hydrogenated pitch in Comparative Example 1 was heat-treated for 5 minutes to form optically anisotropic small spherical particles. The proportion of the small particles was about 5% by volume. The pitch containing the anisotropic small particles, was treated in the same manner as in Example 3 to obtain spinning pitch containing 95% by volume of an optically anisotropic phase. The temperature at which this spinning pitch showed a shear viscosity of 200 poise, was 340° C. This spinning pitch was melt-spun and treated in the same manner as in Comparative Example 1 to obtain carbon fibers. The spinnability and the mechanical properties of the carbon fibers are shown in Table 1.

The glass transition temperature width (ΔTg) of the spinning pitch obtained in this Example was 65° C.

TABLE 1

| | Solubility parameter (δ) of Solvent (a) | Solubility parameter (δ) of Solvent (b) | Number of breakages of fibers of 10 μm in diameter during 2 hours of spinning | Tensile test*1 after carbonization treatment at 2,000° C. | | Compression test at 0° C.*2 | | |
|---|---|---|---|---|---|---|---|---|
| | | | | Tensile strength (kg/mm²) | Tensile modulus (ton/mm²) | Carbonization temp. (°C.) | Compression strength at 0° C. | Modulus of elasticity at 0° C. |
| Comparative Example 1 | — | — | 0 | 405 | 38 | 2460 | 39 | 30 |
| Example 1 | 10.8 | 9.0 | 0 | 373 | 41 | 2350 | 48 | 30 |
| Example 2 | 10.6 | 9.6 | 0 | 367 | 51 | 2150 | 52 | 30 |
| Example 3 | 10.6 | 9.8 | 0 | 317 | 58 | 2070 | 54 | 30 |
| Example 4 | 10.6 | 9.8 | 0 | 352 | 54 | 2100 | 53 | 30 |
| Comparative Example 2 | 10.6 | 9.8 | 2 | 321 | 45 | 2320 | 45 | 30 |

*1: Monofilament (in accordance with JIS R-7601)
*2: Fiber packing density: 60% (in accordance with ASTM D-3410)

As described in the foregoing, spinning pitch for carbon fibers of the present invention presents carbon fibers having a high modulus of elasticity and high compression strength at 0° C., and further presents such a merit that breakage during the spinning operation is little.

We claim:

1. Spinning pitch for carbon fibers, which (1) has a glass transition temperature width of at most 60° C. as measured by a differential scanning calorimeter, (2) contains at least 80% by volume an optically anisotropic phase, and (3) shows a shear viscosity of 200 poise at a temperature of from 270° to 370° C.

2. A process for producing spinning pitch for carbon fibers, said pitch having at least 80% by volume of an optically anisotropic phase and a shear viscosity of 200 poise at a temperature of from 270° C. and 300° C., comprising the steps of:

a) mixing 100 parts by weight of carbonaceous material containing at least 30% by volume of an optically anisotropic phase with from 300 to 2000 parts by weight of a first organic solvent having a solubility parameter of from 9.5 to 11.5 to obtain a first heterogeneous mixture;

b) filtering said first heterogeneous mixture to obtain an insoluble component and a filtrate containing said first organic solvent and a soluble component;

c) removing said first organic solvent from the filtrate and recovering said soluble component;

d) mixing 100 parts by weight of said soluble component with from 300 to 200 parts by weight of a second organic solvent having a solubility parameter of from 8.0 to 10.5 to obtain a second heterogeneous mixture;

e) filtering said second heterogeneous mixture to obtain the desired spinning pitch for carbon fibers and a filtrate containing said second organic solvent and a second soluble component; or f) mixing 100 parts by weight of carbonaceous material containing at least 30% by volume of an optically anisotropic phase with from 300 to 2000 parts by weight of said second organic solvent having a solubility parameter of from 8.0 to 10.5 to obtain a third heterogeneous mixture;

g) filtering said third heterogeneous mixture to obtain an insoluble component and a filtrate containing said second organic solvent and a soluble component;

h) mixing 100 parts by weight of said insoluble component with from 300 to 2000 parts by weight of said first organic solvent having a solubility parameter of from 9.5 to 11.5 to obtain a fourth heterogeneous mixture;

i) filtering said fourth heterogeneous mixture to obtain an insoluble component and a filtrate containing said first organic solvent and the desired spinning pitch for carbon fibers; and j) removing said first organic solvent from said filtrate and recovering the desired spinning pitch for carbon fibers;

wherein the different in solubility parameters between said first organic solvent and said second organic solvent is at least 0.1.

3. The process according to claim 2, wherein said carbonaceous material is coal-originated carbonaceous material.

4. The process according to claim 2, wherein said carbonaceous material has at least 90% by volume of an optically anisotropic phase.

5. The process according to claim 2, wherein the first organic solvent has a solubility parameter of from 10 to 11, and the second organic solvent has a solubility parameter of from 8.5 to 10.

6. The process according to claim 2, wherein the difference in the solubility parameter between the first organic solvent and the second organic solvent is from 0.1 to 3.5.

* * * * *